US009203533B2

(12) United States Patent
Coker et al.

(10) Patent No.: US 9,203,533 B2
(45) Date of Patent: Dec. 1, 2015

(54) SYSTEM AND METHOD FOR REAL-TIME WIRELESS TRANSMISSION OF DIGITAL AUDIO AT MULTIPLE RADIO FREQUENCIES

(75) Inventors: Guy Coker, Rocklin, CA (US); James Purcell, Roseville, CA (US); Marcus Ryle, Westlake Village, CA (US)

(73) Assignee: Line 6, Inc., Calabasas, CA (US)

( * ) Notice: Subject to any disclaimer, the term of this patent is extended or adjusted under 35 U.S.C. 154(b) by 1079 days.

(21) Appl. No.: 12/178,928

(22) Filed: Jul. 24, 2008

(65) Prior Publication Data

US 2010/0022189 A1 Jan. 28, 2010

(51) Int. Cl.

| | |
|---|---|
| ***H04H 20/00*** | (2009.01) |
| ***H04H 20/61*** | (2008.01) |
| ***H04H 20/33*** | (2008.01) |
| *H04H 40/27* | (2008.01) |

(52) U.S. Cl.

CPC ..... *H04H 20/61* (2013.01); *H04H 20/33* (2013.01); *H04H 40/27* (2013.01)

(58) Field of Classification Search

CPC ..... H04B 1/205
USPC ..... 455/41, 500, 101, 103, 104, 132, 137, 455/140

See application file for complete search history.

(56) References Cited

U.S. PATENT DOCUMENTS

| | | | | |
|---|---|---|---|---|
| 5,345,187 | A | 9/1994 | McGuire | |
| 6,301,313 | B1 | 10/2001 | Gevargiz et al. | |
| 6,570,078 | B2 | 5/2003 | Ludwig | |
| 6,621,853 | B1 | 9/2003 | Ku | |
| 6,689,947 | B2 | 2/2004 | Ludwig | |
| 6,852,919 | B2 | 2/2005 | Ludwig | |
| 6,895,059 | B2 | 5/2005 | Rogerson et al. | |
| 6,990,317 | B2 | 1/2006 | Arnold | |
| 7,217,878 | B2 | 5/2007 | Ludwig | |
| 7,309,829 | B1 | 12/2007 | Ludwig | |
| 7,420,112 | B2 * | 9/2008 | Juszkiewicz et al. | 84/600 |
| 7,499,462 | B2 * | 3/2009 | MacMullan et al. | 370/401 |
| 7,786,370 | B2 | 8/2010 | Ludwig | |
| 2002/0005111 | A1 | 1/2002 | Ludwig | |
| 2002/0007723 | A1 | 1/2002 | Ludwig | |
| 2002/0163904 | A1 * | 11/2002 | Rao et al. | 370/347 |
| 2004/0065187 | A1 | 4/2004 | Ludwig | |
| 2005/0130717 | A1 * | 6/2005 | Gosieski et al. | 455/575.2 |
| 2007/0184875 | A1 * | 8/2007 | Rybicki | 455/553.1 |
| 2008/0247571 | A1 * | 10/2008 | Shiga et al. | 381/110 |

OTHER PUBLICATIONS

Office Action dated Aug. 2, 2011, U.S. Appl. No. 12/422,798.
Non-Final Office action dated Jan. 19, 2011 from corresponding U.S. Appl. No. 12/422,798.
Notice of Allowance dated Apr. 12, 2013 from corresponding U.S. Appl. No. 12/422,798.

* cited by examiner

*Primary Examiner* — Wen Huang
(74) *Attorney, Agent, or Firm* — Blakely Sokoloff Taylor & Zafman, LLP

(57) ABSTRACT

Disclosed is a system and method for the real-time wireless transmission of digital audio signals. A transmitter including a processor may be used to: generate a first digital data stream and a second digital data stream from a digital audio signal and transmit the first digital data stream at a first radio frequency and the second digital data stream at a second radio frequency. A receiver including a processor may be utilized to: receive the first and second digital data streams at the first and second radio frequencies, respectively, and generate the digital audio signal from the first and second digital data streams.

28 Claims, 7 Drawing Sheets

SYSTEM AND METHOD FOR REAL-TIME WIRELESS TRANSMISSION OF DIGITAL AUDIO AT MULTIPLE RADIO FREQUENCIES

BACKGROUND

During a recording or live performance, musicians and singers often desire the freedom of being able to have their musical instrument or voice audio signals being connected to recording or amplification devices without the encumbrance of an electrical cable.

Analog wireless systems that transmit audio signals over radio frequencies have existed for many decades and have been a viable solution but they include many limitations. Analog transmission systems for audio signals typically have limited bandwidth and dynamic range and the analog transmission system is susceptible to unwanted radio interference being heard through the audio system. With an analog system, as the radio frequency degrades, or interference occurs, the audio quality degrades.

In typical digital wireless systems, once the radio signal has degraded to a level in which the digital data is unreadable, the audio signal must be muted. As a result, typical digital audio wireless systems often include bidirectional communications that permit the receiver to request the retransmission of the digital audio data. Unfortunately, latency (i.e., delay time) is introduced to allow time for the retransmission.

In many cases, the latency associated with the wireless transmission of digital audio can be easily tolerated. For example, digitally transmitting audio that is being played from a recording can contain latency in the tens of milliseconds without being obvious to the listener.

On the other hand, performers of live music can tolerate only very low latency (e.g., 5 milliseconds or less) before the latency can negatively affects the performance and interaction of musicians. As a result, present techniques for the retransmission of digital audio are not a viable solution because of the amount of time required for retransmission.

DETAILED DESCRIPTION

Figure 1:
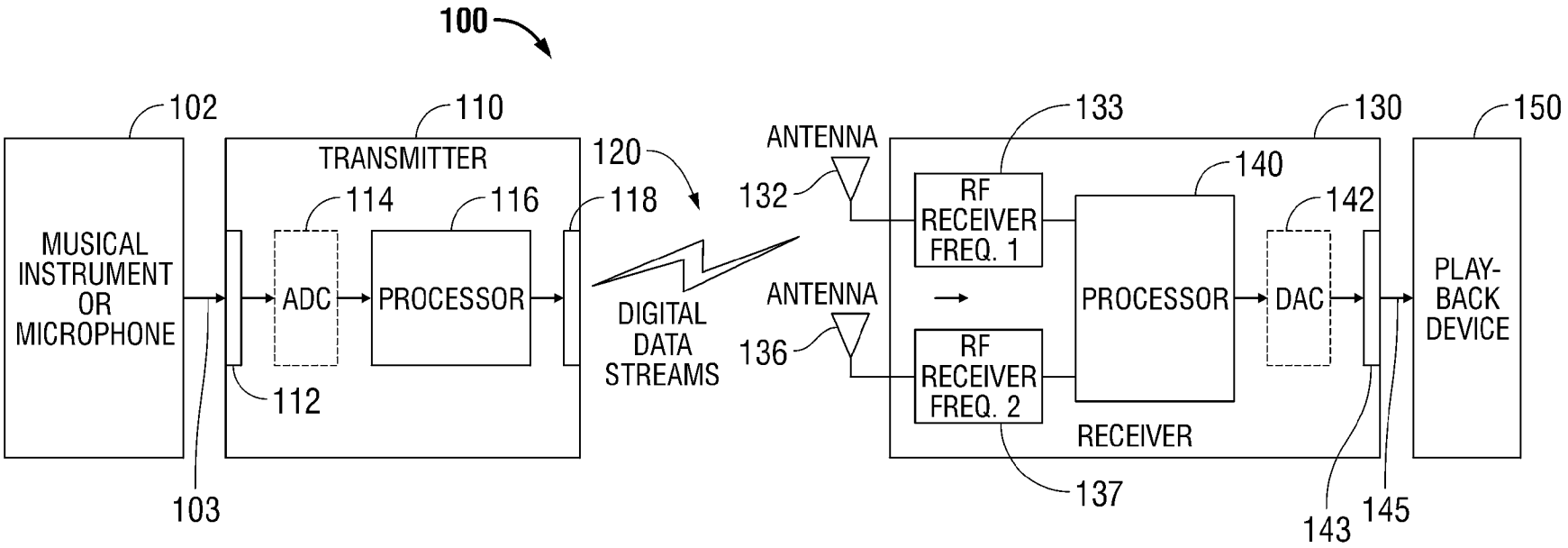
FIG. 1 is a block diagram of a system for the wireless transmission of digital audio signals, according to one embodiment of the invention.

In the following description, the various embodiments of the present invention will be described in detail. However, such details are included to facilitate understanding of the invention and to describe exemplary embodiments for implementing the invention. Such details should not be used to limit the invention to the particular embodiments described because other variations and embodiments are possible while staying within the scope of the invention. Furthermore, although numerous details are set forth in order to provide a thorough understanding of the present invention, it will be apparent to one skilled in the art that these specific details are not required in order to practice the present invention. In other instances details such as, well-known methods, types of data, protocols, procedures, components, processes, interfaces, electrical structures, circuits, etc. are not described in detail, or are shown in block diagram form, in order not to obscure the present invention. Furthermore, aspects of the invention will be described in particular embodiments but may be implemented in hardware, software, firmware, middleware, or a combination thereof.

In the following description, certain terminology is used to describe features of the invention. For example, a "component", or "computing device", or "client device", or "computer" includes hardware and/or software module(s) that are configured to perform one or more functions.

Further, a "processor" is logic that processes information. Examples of a processor include a central processing unit (CPU), microprocessor, an application specific integrated circuit (ASIC), a digital signal processor (DSP), a micro-controller, a finite state machine, a field programming gate array (FPGA), combinatorial logic, etc.

A "software module" is executable code such as an operating system, an application, an applet or even a routine. Software modules may be stored in any type of memory, namely suitable storage medium such as a programmable electronic circuit, a semiconductor memory device, a volatile memory (e.g., random access memory, etc.), a non-volatile memory (e.g., read-only memory, flash memory, etc.), a floppy diskette, an optical disk (e.g., compact disk or digital versatile disc "DVD"), a hard drive disk, tape, or any kind of interconnect (defined below).

A "connector," "interconnect," or "link" is generally defined as an information-carrying medium that establishes a communication pathway. Examples of the medium include a physical medium (e.g., electrical cable, electrical fiber, optical fiber, bus traces, etc.) or a wireless medium (e.g., air in combination with wireless signaling technology).

"Information" or "data stream" is defined as data, address, control or any combination thereof. For transmission, information may be transmitted as a message, namely a collection of bits in a predetermined format. One particular type of message is a frame including a header and a payload, each having a predetermined number of bits of information.

Embodiments of the invention relate to a system and method for the wireless transmission of digital audio signals. In one embodiment, a transmitter including a processor may be used to: generate a first digital data stream and a second digital data stream from a digital audio signal and transmit the first digital data stream at a first radio frequency and the second digital data stream at a second radio frequency. A receiver including a processor may be utilized to: receive the first and second digital data streams at the first and second radio frequencies, respectively, and generate the digital audio signal from the first and second digital data streams.

With reference now to FIG. 1, FIG. 1 is a block diagram of a system 100 for the wireless transmission of digital audio signals, according to one embodiment of the invention. As shown in FIG. 1, a musical instrument or microphone 102 may be coupled to a transmitter 110. For example, musical instrument 102 may be a guitar, a piano, a keyboard, a base, or any type of musical instrument. Additionally, a microphone may be coupled to transmitter 110.

The musical instrument or microphone may be a digital or analog device. Typically, musical instrument or microphone 102 is coupled via a wired connector 103 (analog or digital), such as an electric cable, to an input device (analog or digital) 112 for transmitter 110. Thus, transmitter 110 is coupled to the musical instrument 102. Additionally, transmitter 110 may be directly attached or built into musical instrument or microphone 102 so as to appear to be one device.

Transmitter 110 may include an analog to digital converter (ADC) 114 coupled to a processor 116 and a digital wireless output device 118 coupled to processor 116.

It should be appreciated that ADC 114 may or may not be utilized dependent upon the type of musical instrument or microphone 102. For example, musical instruments or microphones 102 that are digital may be directly coupled by digital input device 112 to processor 116.

On the other hand, analog musical instruments or microphones may be connected via analog input device 112 to ADC 114 such that the analog audio signals are converted by ADC 114 to a digital signal for processing by processor 116.

For example, transmitter 110 may include a button selectable by a user to indicate whether or not an analog or digital musical instrument or microphone is being utilized to turn on or off ADC 114. Alternatively, transmitter 110 may simply determine whether a digital or analog signal is being utilized and select or deselect ADC 114.

In either event, processor 116 of transmitter 110 is utilized to generate digital data streams 120 for transmission to a receiver 130 through digital wireless output device 118.

In particular, processor 116 generates at least a first digital data stream and a second digital data stream from the digital audio signal from ADC 114 or directly from the digital musical instrument or microphone. Next, transmitter 110 through digital wireless output device 118 transmits the first digital data stream at a first radio frequency and the second digital data stream at a second radio frequency (shown as digital data streams 120), as will be described in more detail later, to receiver 130.

The digital representation of the digital audio signal is prepared by processor 116 for wireless transmission. Thus, processor 116 generates digital data streams 120 at particular frequencies for wireless transmission. Examples of a processor include a central processing unit (CPU), microprocessor, an application specific integrated circuit (ASIC), a digital signal processor (DSP), a micro-controller, a finite state machine, a field programming gate array (FPGA), combinatorial logic, etc.

These functions can be implemented by processor 116 as one or more instructions (e.g. code segments), to perform the desired functions or operations of the invention. When implemented in software (e.g. by a software or firmware module), the elements of the present invention are the instructions/code segments to perform the necessary tasks. The instructions which when read and executed by a machine or processor, cause the machine or processor to perform the operations necessary to implement and/or use embodiments of the invention. The instructions or code segments can be stored in a machine readable medium (e.g. a processor readable medium or a computer program product), or transmitted by a computer data signal embodied in a carrier wave, or a signal modulated by a carrier, over a transmission medium or communication link.

Further, processor 116 may process the digital audio data such that it also includes additional codings such as: error correction code (ECC), cyclic redundancy check (CRC), control codes, information data, or other type of coding; that is embedded along with the digital audio data. Thus, control data and information data may also be included with the digital audio data to be wirelessly transmitted from transmitter 110 to receiver 130. For example, such control and information data that may be transmitted includes battery voltage, positional data, user interface controls (e.g. buttons, knobs, etc.) of the transmitter, musical instrument, or microphone related to volume, gain, tone, pick-up selections, etc.

After the digital audio data is ready for wireless transmission, processor 116 through digital wireless output device 118 sends the digital audio data through digital data streams 120 at different radio frequencies to receiver 130. Particularly, the digital audio data may be sent on as little as two separate radio frequencies or as many as n frequencies, as will be described in more detail later.

Digital data streams 120 that include at least first and second digital data streams at first and second radio frequencies, respectively, are received at receiver 130. For example, in one embodiment, receiver 130 may include a first antenna 132 coupled to a first RF Receiver 133 operating at the first frequency and a second antenna 136 coupled to a second RF Receiver 137 operating at the second radio frequency both of which may be coupled to processor 140.

Processor 140 may then generate the same digital audio signal from the first and second digital data streams for transmission to a play-back device 150 such that the play-back device can play the generated digital audio signal. For example, play-back device 150 may be an amplifier, a stereo, head-phones, or other well-known types of play-back devices.

Further, the generated digital audio signal may be converted by a digital to analog converter (DAC) 142 into an analog signal that is transmitted through output device 143 and through wired connector 145 for play-back by play-back device 150 that is an analog play-back device.

It should be appreciated that play-back device 150, in some embodiments, may be a digital play-back device and the digital audio signal may be directly played back, without conversion by DAC 142, by being sent through output device 143 and through wired connector 145 to play-back device 150 that is a digital play-back device. For example, at the receiver device 130, a user may select analog or digital play-back by a suitable button selection or receiver 130 may determine the type of play-back device attached to receiver 130 and selects whether to utilize or not utilize DAC 142. Additionally, receiver 130 may be directly attached to or embedded within play-back device 150 so as to appear as a single device.

Thus, receiver 130 receives digital data streams 120 including at least first and second digital data streams transmitted at first and second radio frequencies, respectively. However, different numbers of digital data streams and radio frequencies may be utilized, as will be described in more detail later.

In one embodiment, processor 140 decodes the received multiple digital data streams and converts them into the same transmitted digital audio signal and sends the digital audio signal to DAC 142, internal to receiver 130, for conversion to analog audio for play-back by an analog audio play-back device, such as an amplifier.

Additionally, as will be described in more detail later, either the analog or digital audio signals may be sent back to storage devices, recording devices, recording equipment, computers, or stereos.

The digital data streams 120 may be sent utilizing device specific digital audio formats or by existing digital audio formats such as audio engineering society (AES)/European Broadcasting Union (EBU) or S/PDIF formats. As will be described, the digital data streams may be received simultaneously or in multiple time slots.

Further, although two antennas 132 and 136 and corresponding RF receivers 133 and 137 are shown in receiver 130, it should be appreciated that only one antenna and one RF receiver may be utilized or multiple antennas and multiple RF receivers may be utilized and interconnected depending upon the type of application. Thus, any combination of multiple antennas and multiple receivers may be utilized.

In one embodiment, musical instrument or microphone 102 may be connected to transmitter 110 and thereby wirelessly to receiver 130 for a live performance. In this embodiment, the sizes of the first and second digital data streams 120 and the frequencies of the first and second radio frequencies are selected by processor 116 of transmitter 110 to ensure a low latency generation of the digital audio signal at receiver 130 and low latency play-back of the generated audio signal at the play-back device 150, such as an amplifier.

In one embodiment, the low latency may be less than five milliseconds.

By utilizing more than one radio frequency for operation, this allows for interference from outside radio frequencies to reduce the jamming of the radio frequency signals used by transmitter 110 to receiver 130. This type of transmission allows for low latency because there is no long block code or retransmission needed to cover for a jammed frequency during a time period. The end result is more data throughput due to less interference. When interference does occur, the data errors that are received can be easily corrected or concealed by processor 140 of receiver 130 without notice to the user or audience. Thus, the result is a real-time wireless audio device that has low enough latency for pro-audio use while still providing significant resistance to data loss due to radio frequency interference.

Figure 2:
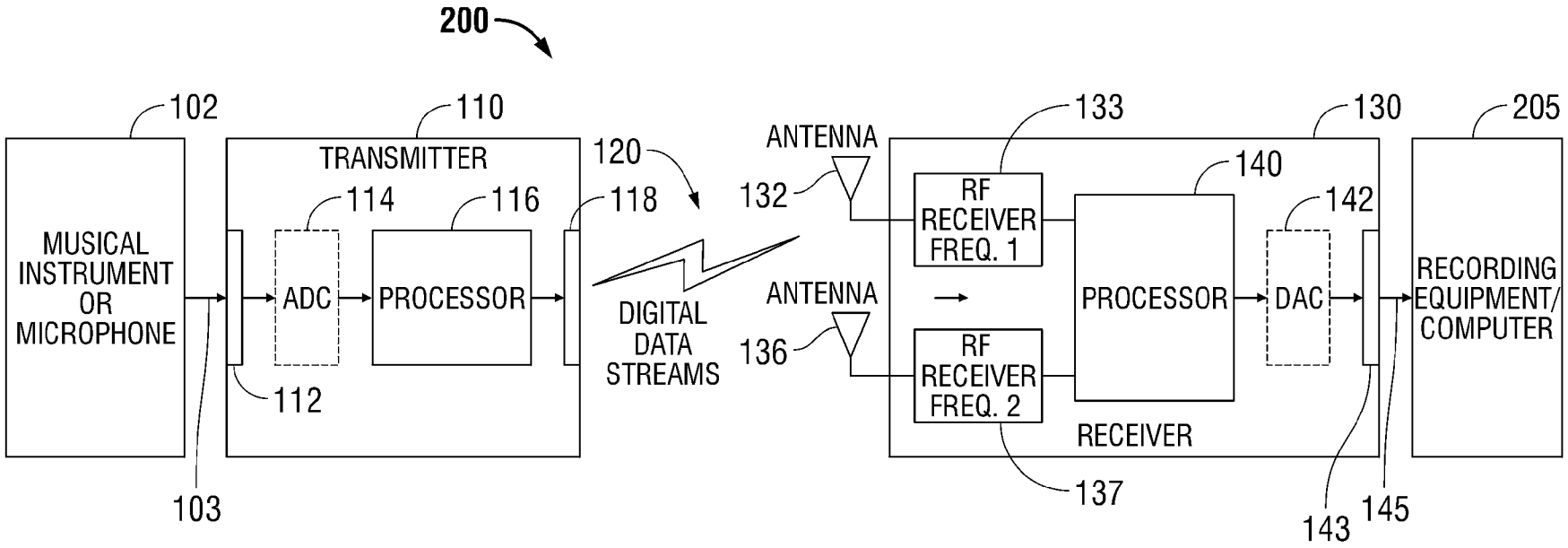
FIG. 2 is a block diagram of a system for the wireless transmission of digital audio signals, according to one embodiment of the invention.

With reference now to FIG. 2, FIG. 2 is a block diagram of a system 200 for the wireless transmission of digital audio signals, according to one embodiment of the invention. System 200 is very similar to previously-described system 100. It should be noted that as shown in FIG. 2, a musical instrument or microphone 102 may be wirelessly connected through transmitter 110 and receiver 130, as previously described. However, in system 200 instead of a digital or analog play-back device, musical instrument or microphone 102 is connected to digital or analog recording equipment or a computer system 205.

Figure 3:
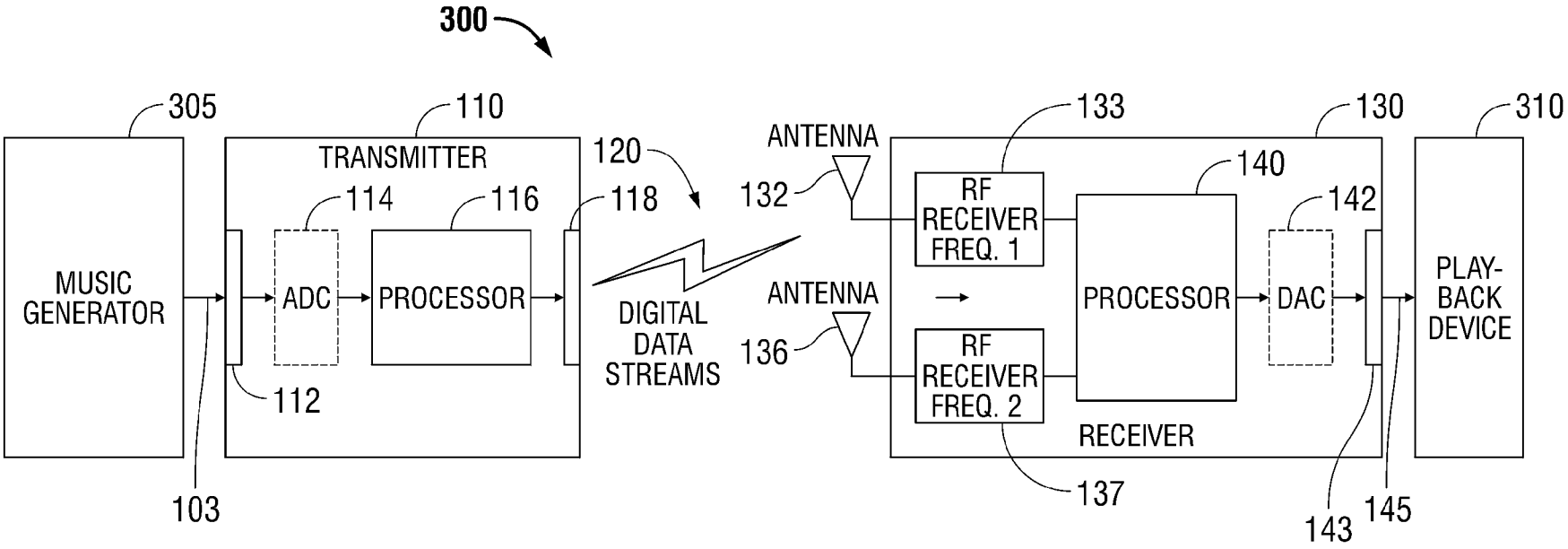
FIG. 3 is a block diagram of a system for the wireless transmission of digital audio signals, according to one embodiment of the invention.

With reference now to FIG. 3, FIG. 3 is a block diagram of a system 300 for the wireless transmission of digital audio signals, according to one embodiment of the invention. System 300 is very similar to previously-described system 100. However, in system 300, a musical generator 305 is wirelessly connected to a digital or audio play-back device 310 through transmitter 110 and receiver 130, as previously described.

Music generator 300 may be a compact disk (CD) player, a digital video disk (DVD), an MP3 player, a computer, a cassette player, a record player or other types of digital or analog music generators and may be wirelessly connected between transmitter 110 and receiver 130 to a digital or analog play-back device 310, as previously described.

In one embodiment of the invention, digital audio data is transmitted by transmitter 110 in part or in whole on at least two independent radio frequencies for a single audio digital data stream 120. Data interleaving, error detection, error correction, and distribution techniques may be utilized to maximize the amount of breaks in transmission that can be tolerated with no interruption of audio or with subtle error concealment. Because there is data available on at least two independent frequencies, one of the frequencies may be unreadable at the receiver 130 for up to an indefinite period of time while audio can still be heard through a play-back device due to the data on the alternate frequency.

As will be described, the transmission by transmitter 110 of multiple frequencies can be simultaneous or alternating in nature. The data transmitted on the separate frequencies may be redundant data or interleaved data. The number of frequencies can be as little as two separate frequencies, however, may be up to any number (n) of separate frequencies. The frequencies can be collected at the receiver 130 simultaneously or alternating at some combination thereof.

The digital data streams may be sent utilizing device specific digital audio formats or by existing digital audio formats such as audio engineering society (AES)/European Broadcasting Union (EBU) or S/PDIF formats.

Further, it should be appreciated that techniques for the wireless transmission of digital data through useable radio frequency bands is well known to those of skill in the art. As is well known, radio frequency bands may be selected by transmitter 110 and receiver 130 for digital data streams 120 at any useable frequency band, and can utilize any of the well known methods for transmitting data through radio frequency bands such as: FSK, CPFSK, MFSK, QPSK, QAM, OFDM, etc.

Figure 4:
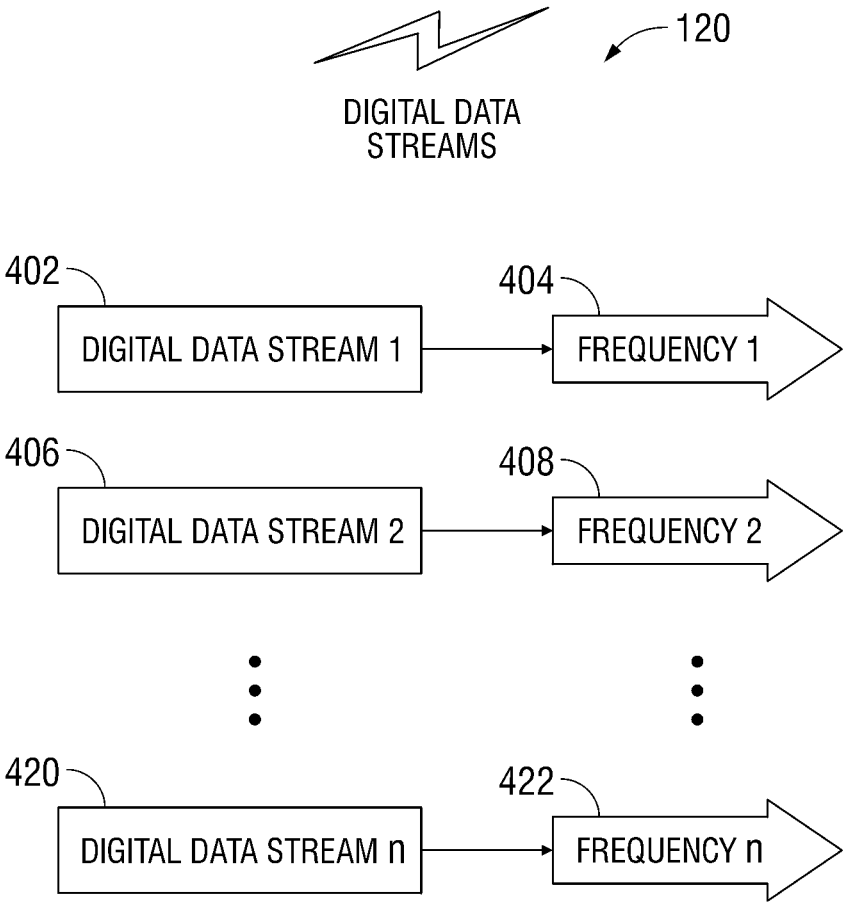
FIG. 4 is a block diagram illustrating components of digital data streams, according to one embodiment of the invention.

Turning now to FIG. 4, FIG. 4 is a block diagram illustrating components of digital data streams 120, according to one embodiment of the invention. As can be seen in FIG. 4, digital data streams 120 may include any number of digital data streams. For example, digital data streams 120 may include a first digital data stream 1 402 at a first RF frequency 1 404, a second digital data stream 2 406 at a second radio frequency 2 408, up to a predetermined digital data stream n 420 at RF frequency n 422. Thus, digital data streams 120 may include any number of predetermined digital data streams at predetermined frequencies.

In one embodiment, as previously described, digital data streams 120 may include a first digital data stream 402 transmitted at a first radio frequency 404 and a second digital data stream 406 transmitted at a second radio frequency 408.

As can be seen in FIG. 4, each digital data stream may be transmitted by the transmitter 110 completely independently from the others on different radio frequencies. These frequencies may be separated in such a manner that they do not interfere with one another. Thus, individual data streams are allowed to arrive at the receiver 130 uninterrupted by the other independent transmissions. These data streams may be sent simultaneously or may be time multiplexed. In particular, these data streams may be different data, such as interleaved data, or redundant data.

Thus, in one embodiment, first and second digital data streams 402 and 406 generated by transmitter 110 for transmission at first and second radio frequencies 404 and 408 may be redundant data. Alternatively, in another embodiment, the first and second digital data streams 402 and 406 generated for transmission by transmitter 110 at the first and second radio frequencies 404 and 408 may be interleaved data. Thus, these data streams may be different data, such as interleaved data, or redundant data. Collision avoidance of these transmissions can be achieved by using frequencies adequately spaced in frequency or adequately time spaced. The collision avoidance may also use both time spacing and frequency spacing simultaneously.

Figure 5:
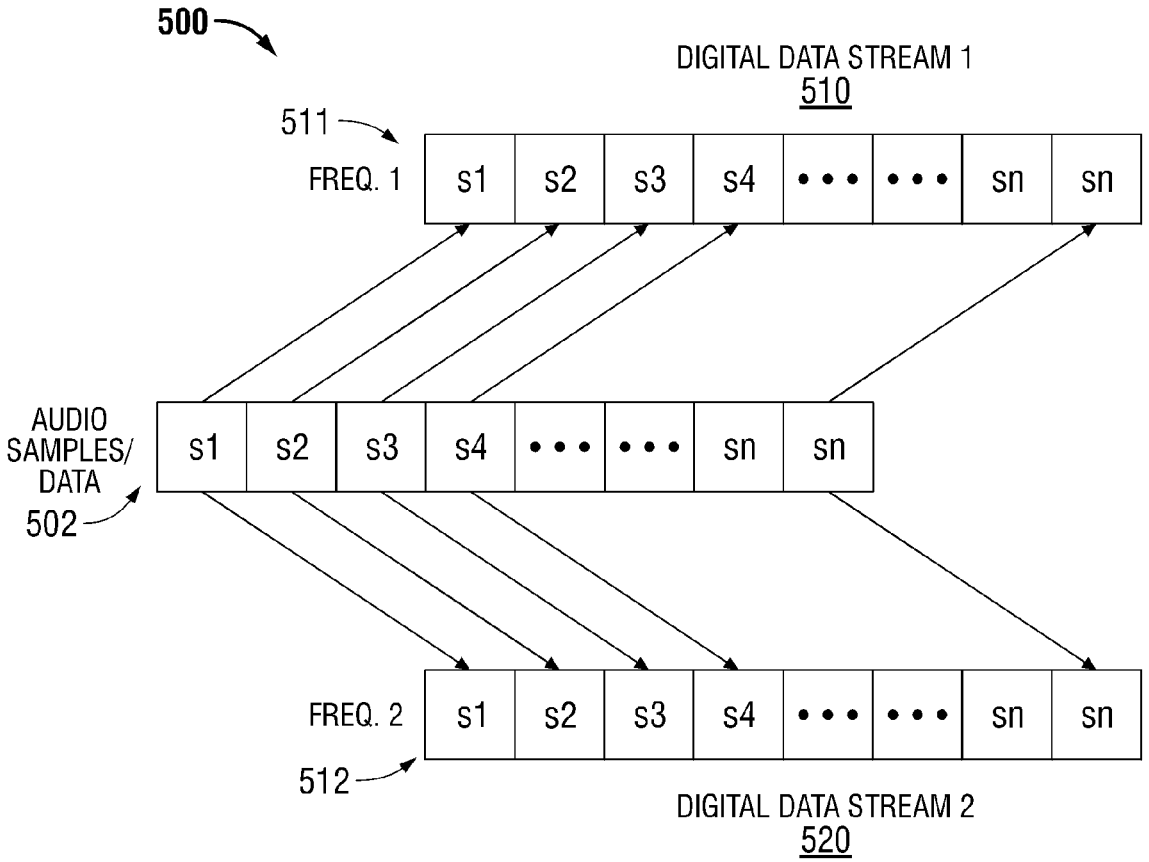
FIG. 5 is a block diagram illustrating digital audio samples/data being sent as first and second digital data streams at first and second radio frequencies as redundant data, according to one embodiment of the invention.

Turning now to FIG. 5, FIG. 5 is a block diagram 500 illustrating digital audio samples/data 500 (s1,s2,s3 . . . sn) being sent as first and second digital data streams 510 (s1,s2, s3 . . . sn) and 520 (s1,s2,s3 . . . sn) generated by the transmitter for transmission at first and second radio frequencies 511 and 512 as redundant data, according to one embodiment of the invention.

Thus, audio samples/data502 are sent at two frequencies 511 and 512 and are sent as redundant data samples 510 and 520 of a certain size on each frequency. The number of data samples to be sent on each frequency may be of predetermined size and may be repeatedly sent in those same packet sizes. The data sample packets may also vary in length each time the frequencies are repeated in nature. In all scenarios, redundant data may be sent on each frequency.

Figure 6:
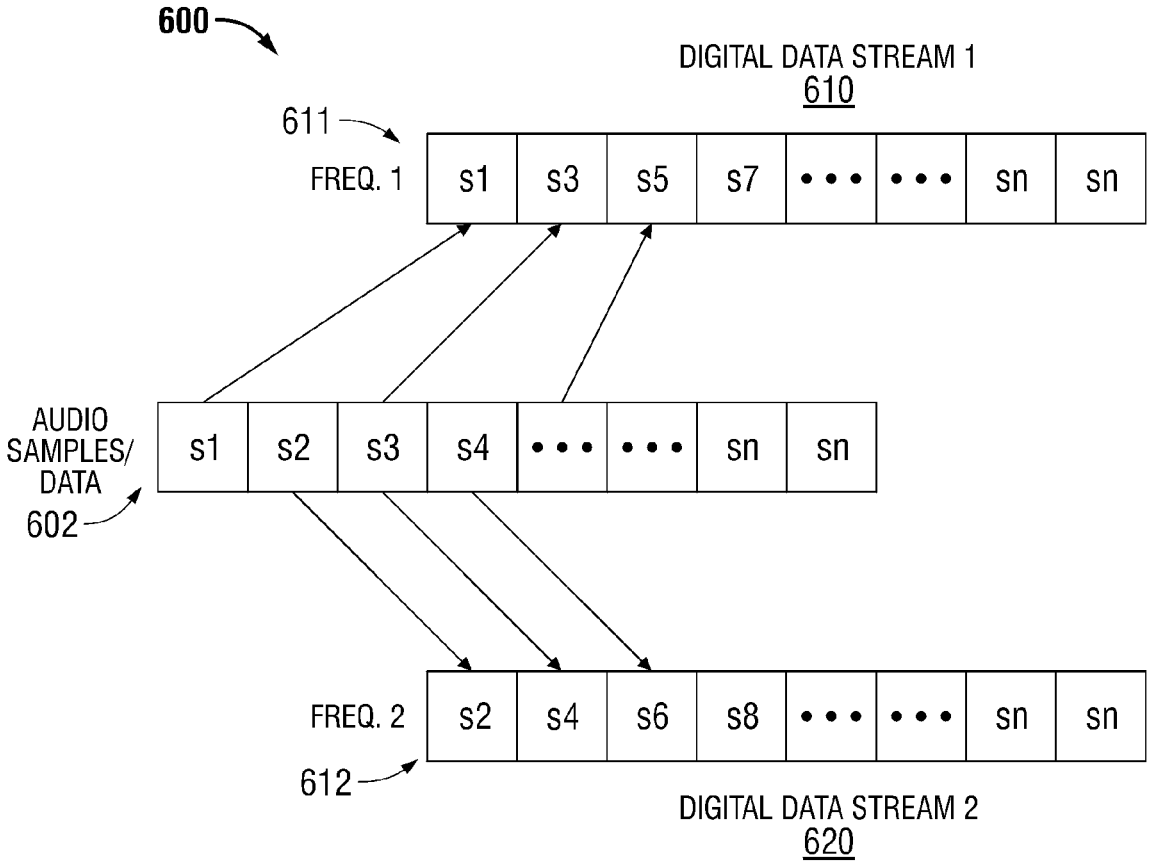
FIG. 6 is a block diagram illustrating digital audio samples/data being sent as first and second digital data streams at first and second radio frequencies as interleaved data, according to one embodiment of the invention.

With reference now to FIG. 6, FIG. 6 is a block diagram 600 illustrating digital audio samples/data 602 (s1,s2,s3,s4, s5,s6 . . . sn) being sent as first and second digital data streams 610 (s1,s3,s5 . . . sn) and 620 (s2,s4,s6 . . . sn) generated by the transmitter for transmission at first and second radio frequencies 611 and 612 as interleaved data, according to one embodiment of the invention. Thus, two frequencies 611 and 612 are utilized with alternating data samples. It should be appreciated that the frequencies 611 and 612 can be sent simultaneously or at some predetermined alternating time slots.

In particular, the interleaved data includes data samples that are alternated at the first radio frequency 611 and the second radio frequency 612 such that if an interference occurs at one of the first or second radio frequencies 611 or 612, the digital audio signal received at the receiver may be reconstructed by interpolating between the data samples on the one of the first radio frequency 611 or the second radio frequency 612 that is not subject to interference.

Figure 7:
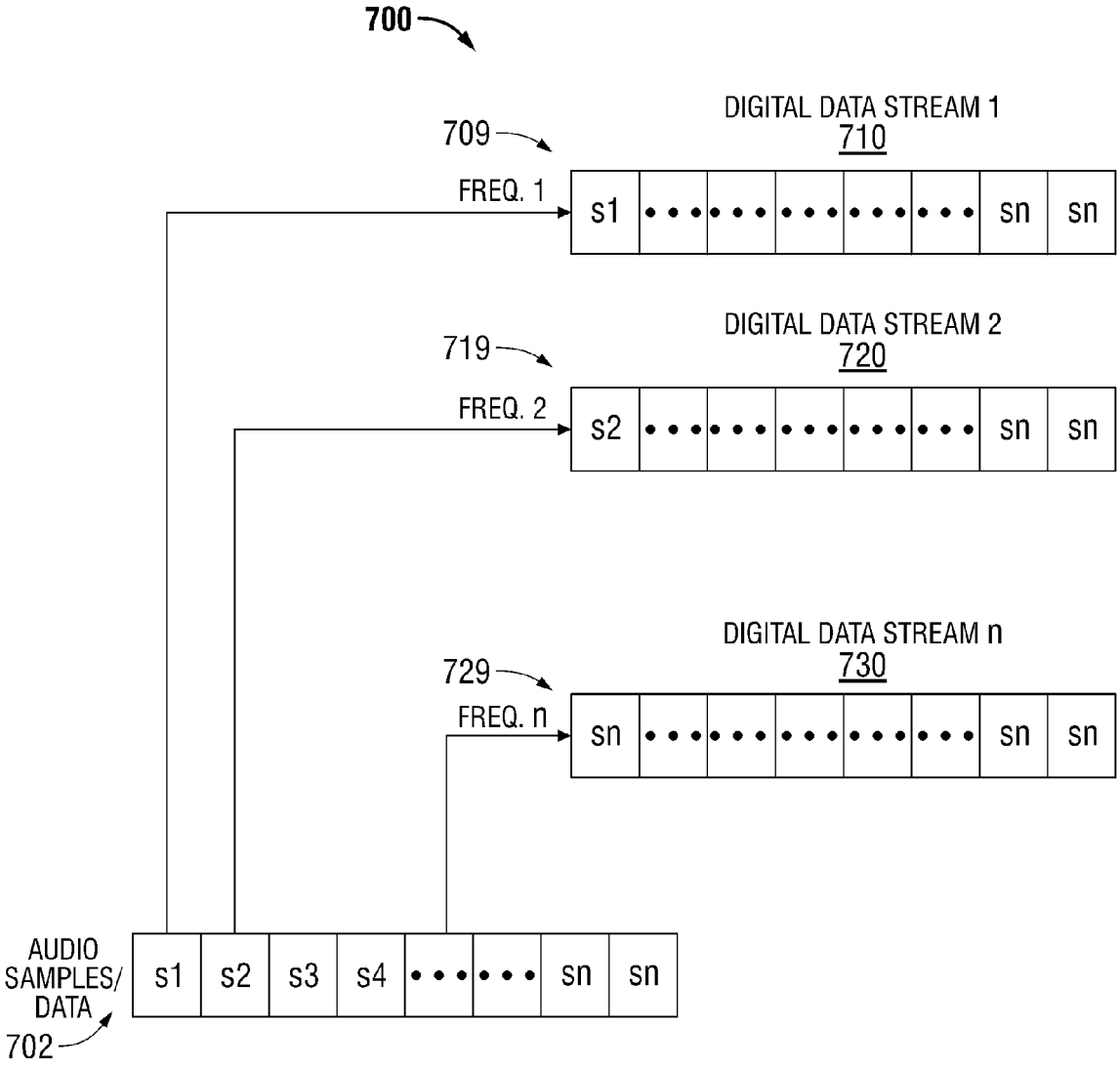
FIG. 7 is a block diagram illustrating digital audio samples/data being sent in multiple data streams at multiple frequencies, according to one embodiment of the invention.

With reference now to FIG. 7, FIG. 7 is a block diagram 700 illustrating a digital audio samples/data702 (s1,s2,s3, s4 . . . sn) being sent in multiple data streams at multiple frequencies, according to one embodiment of invention.

In particular, FIG. 7 is a block diagram 700 illustrating an embodiment where n frequencies are used to send n data samples of a certain size on each frequency. For example, at frequency 1 709, digital data stream 1 710 includes data samples s1 . . . sn. At frequency 2 719, digital data stream 2 720 includes data samples s2 . . . sn. Lastly, as an example, frequency n 729 includes digital data stream n 730 with data samples sn . . . sn. All of these are derived from digital audio samples/data702 sn . . . sn.

The number of data samples to be sent at each frequency may be of a predetermined size and may be repeatedly sent in those same packet sizes. The data sample packets may also vary in length per frequency. For example, three data samples in succession may be utilized on each frequency. Another example may be to send three samples on frequency 1, five samples on frequency 2, two samples on frequency 3, etc. The size of sample packets may also be determined in a random nature.

It should be noted that in the radio spectrum there are a wide range of frequencies over a wide range of applications and there is never any guaranteed radio frequency. Further, there is always the risk of transmission interrupt. For example, in the radio spectrum, many types of errors may occur due to different types of devices that may occupy the same radio frequencies. Examples of these include police radio transmissions, military police radio transmissions, fire radio transmissions, different radios, etc. When digital interference occurs, the digital audio data from a transmitter may not be received.

In order to account for this, error detection, error correction, and distribution techniques (e.g., utilizing ECC, CRC, etc.) may be utilized in conjunction with the previously-described redundant and interleaved digital data streams transmitted at multiple radio frequencies set forth in FIGS. 4-7 to maximize the amount of breaks in transmission that can be tolerated with no interruption of audio or subtle error concealment. Types of error correction can be used to correct data samples or conceal data samples. Various methods for the interpolation of missing samples and error correction and detection are well known in the art. For example, utilizing error correction signals may be used to correct missing data symbols.

In particular, as previously described, by utilizing multiple radio frequencies in the transmission of digital data streams for a digital audio signal in accordance with embodiments of the invention, this allows for interference from outside radio frequencies to reduce the jamming of the radio frequency signals used by the transmitter to the receiver. Thus, latency is kept to a minimum. This type of transmission allows for low latency because there is no long block code or retransmission needed to cover for a jammed frequency during a time period. The end result is more data throughput due to less interference. When interference does occur, the data errors that are received can be easily corrected or concealed by the processor of the receiver without notice to the user or audience. Thus, the result is a robust real-time wireless audio device that has low enough latency for pro-audio use.

While the present invention and its various functional components have been described in particular embodiments, it should be appreciated the embodiments of the present invention can be implemented in hardware, software, firmware, middleware or a combination thereof and utilized in systems, subsystems, components, or sub-components thereof.

When implemented in software (e.g. as a software module), the elements of the present invention are the instructions/code segments to perform the necessary tasks. The program or code segments can be stored in a machine readable medium, such as a processor readable medium or a computer program product, or transmitted by a computer data signal embodied in a carrier wave, or a signal modulated by a carrier, over a transmission medium or communication link. The machine-readable medium or processor-readable medium may include any medium that can store or transfer information in a form readable and executable by a machine (e.g. a processor, a computer, etc.). Examples of the machine/processor-readable medium include an electronic circuit, a semiconductor memory device, a ROM, a flash memory, an erasable programmable ROM (EPROM), a floppy diskette, a compact disk CD-ROM, an optical disk, a hard disk, a fiber optic medium, a radio frequency (RF) link, etc. The computer data signal may include any signal that can propagate over a transmission medium such as electronic network channels, optical fibers, air, electromagnetic, RF links, etc. The code segments may be downloaded via computer networks such as the Internet, Intranet, etc.

While this invention has been described with reference to illustrative embodiments, this description is not intended to be construed in a limiting sense. Various modifications of the illustrative embodiments, as well as other embodiments of the invention, which are apparent to persons skilled in the art to which the invention pertains are deemed to lie within the spirit and scope of the invention.

What is claimed is:

1. A system for the wireless transmission of a digital audio signal comprising:

a transmitter including a processor to:

generate a first digital data stream and a second digital data stream from a digital audio signal, the digital audio signal including an audio signal generated by a musical instrument or by a microphone, wherein at least one of the first digital data stream and the second digital data stream includes at least one of an error correction code or an error detection code, wherein at least one of the first digital data stream and the second digital data stream includes control data, the control data including user interface controls of the transmitter or control data from a device connected to the transmitter; and transmit the first digital data stream at a first radio frequency and the second digital data stream at a second radio frequency, wherein the first and second digital streams generated by the transmitter for transmission at the first and second radio frequencies are interleaved data, and wherein the interleaved data includes data samples of the digital audio signal that are alternated at the first radio frequency and the second radio frequency; and a receiver including a processor to:

receive the first and second digital data streams at the first and second radio frequencies, respectively; and generate the digital audio signal from the first and second digital data streams.

2. The system of claim 1, wherein the processor of the receiver is configured to generate the digital audio signal from the first and second digital data streams at least by:

reconstructing the digital audio signal, wherein the processor of the receiver is configured to reconstruct the digital audio signal using at least the interleaved data, and wherein the processor of the receiver is configured to reconstruct the digital audio signal only if at least one of the first and second radio frequencies is subjected to an interference.

3. The system of claim 1, wherein at least one of the musical instrument or the microphone is coupled to the transmitter and wherein a play-back device is coupled to the receiver.

4. The system of claim 3, wherein at least one of the musical instrument or the microphone contains the transmitter.

5. The system of claim 3, wherein the play-back device contains the receiver.

6. The system of claim 3, wherein the musical instrument is a digital musical instrument.

7. The system of claim 3, wherein the musical instrument is an analog musical instrument and wherein the transmitter further comprises an analog to digital converter to convert the analog audio signal into at least one portion of the digital audio signal that is used to generate the first and second digital data streams.

8. The system of claim 3, wherein at least one of the musical instrument or the microphone is connected to the receiver via the transmitter for a live performance.

9. The system of claim 1, wherein at least one of the musical instrument or the microphone is coupled to the transmitter and wherein a computer is coupled to the receiver.

10. The system of claim 1, wherein at least one of the musical instrument or the microphone is coupled to the transmitter, wherein the musical instrument includes a music generator and wherein a play-back device is coupled to the receiver.

11. The system of claim 1, wherein the processor of the transmitter is configured to transmit the first digital data stream at the first radio frequency and the second digital data stream at the second radio frequency simultaneously.

12. The system of claim 1, wherein the processor of the transmitter is configured to transmit the first digital data stream at the first radio frequency and the second digital data stream at the second radio frequency at alternating time slots.

13. The system of claim 1, wherein the processor of the transmitter is configured to transmit the first digital data stream at the first radio frequency and the second digital data stream at the second radio frequency at least by collision avoidance and wherein the collision avoidance includes using at least one of:

frequencies adequately spaced in frequency; and frequencies adequately spaced in time.

14. A method for the wireless transmission of a digital audio signal comprising:

generating a first digital data stream and a second digital data stream from a digital audio signal, the digital audio signal including an audio signal generated by a musical instrument or by a microphone, wherein at least one of the first digital data stream and the second digital data stream includes at least one of an error correction code or an error detection code, wherein at least one of the first digital data stream and the second digital data stream includes control data, the control data including user interface controls of the transmitter or control data from a device connected to the transmitter;

transmitting the first digital data stream at a first radio frequency and the second digital data stream at a second radio frequency, wherein the first and second digital streams generated for transmission at the first and second radio frequencies are interleaved data, and wherein the interleaved data includes data samples of the digital audio signal that are alternated at the first radio frequency and the second radio frequency;

receiving the first and second digital data streams at the first and second radio frequencies, respectively; and generating the digital audio signal from the first and second digital data streams.

15. The method of claim 14, wherein the generating the digital audio signal from the first and second digital data streams includes:

reconstructing the digital audio signal, wherein the reconstructing the digital audio includes using at least the interleaved data, and wherein the reconstructing the digital audio signal is performed only if at least one of the first and second radio frequencies is subjected to an interference.

16. The method of claim 14, wherein, the digital audio signal generated from the first and second digital data streams is played by a play-back device.

17. The method of claim 16, wherein the musical instrument is a digital musical instrument.

18. The method of claim 16, wherein the musical instrument is an analog musical instrument and wherein the analog audio signal is converted into at least one portion of the digital audio signal that is used to generate the first digital data stream and the second digital data stream.

19. The method of claim 16, wherein the first and second digital data streams are generated and transmitted during a live performance.

20. The method of claim 14, wherein, the digital audio signal generated from the first and second digital data streams is coupled to a computer.

21. The method of claim 14, wherein the musical instrument includes a musical generator, wherein the generating the first digital data stream and the second digital data stream from the digital audio signal includes an audio signal generated by the musical generator, and wherein, the digital audio signal generated from the first and second digital data streams is played by a play-back device.

22. A system for the wireless transmission of a digital audio signal comprising:

at least one of a microphone or a musical instrument;

a transmitter coupled to at least one of the microphone or the musical instrument, the transmitter including a processor to:

generate a first digital data stream and a second digital data stream from a digital audio signal from at least one of the microphone or the musical instrument, wherein at least one of the first digital data stream and the second digital data stream includes at least one of an error correction code or an error detection code, wherein at least one of the first digital data stream and the second digital data stream includes control data, the control data including user interface controls of the transmitter or control data from a device connected to the transmitter; and transmit the first digital data stream at a first radio frequency and the second digital data stream at a second radio frequency, wherein the first and second digital streams generated by the transmitter for transmission at the first and second radio frequencies are interleaved data, and wherein the interleaved data includes data samples of the digital audio signal that are alternated at the first radio frequency and the second radio frequency;

a receiver including a processor to:

receive the first and second digital data streams at the first and second radio frequencies, respectively;

generate the digital audio signal from the first and second digital data streams; and a play-back device coupled to the receiver to play the generated digital audio signal, wherein at least one of the microphone or the musical instrument is connected to the receiver via the transmitter, and wherein the generation of the digital audio signal from the first and second digital data streams includes:

reconstructing the digital audio signal, wherein the processor of the receiver is configured to reconstruct the digital audio signal using at least the interleaved data, and wherein the processor of the receiver is configured to reconstruct the digital audio signal only if at least one of the first and second radio frequencies is subjected to an interference.

23. The system of claim 22, wherein sizes of the first and second digital data streams and frequencies of the first and second radio frequencies are selected to ensure a low latency generation of the digital audio signal at the receiver and to ensure play-back of the low latency generated audio signal through the play-back device.

24. The system of claim 23, wherein the low latency generation is less than five milliseconds.

25. The system of claim 22, wherein the musical instrument is a digital musical instrument.

26. The system of claim 22, wherein the musical instrument is an analog musical instrument and wherein the transmitter further comprises an analog to digital converter to convert the analog audio signal into at least one portion of the digital audio signal that is used to generate the first digital data stream and the second digital data stream.

27. The system of claim 22, wherein at least one of the microphone or the musical instrument contains the transmitter.

28. The system of claim 22, wherein the play-back device contains the receiver.

* * * * *